US006023600A

United States Patent [19]

Julien et al.

[11] Patent Number: 6,023,600

[45] Date of Patent: Feb. 8, 2000

[54] ION CHARGING DEVELOPEMENT SYSTEM

[75] Inventors: Paul C. Julien, Webster; Elliott A. Eklund, Penfield, both of N.Y.

[73] Assignee: Xerox Corporation, Stamford, Conn.

[21] Appl. No.: 09/144,488

[22] Filed: Aug. 31, 1998

[51] Int. Cl.[7] ..... G03G 15/08

[52] U.S. Cl. ..... 399/266; 399/53; 399/291; 430/120

[58] Field of Search ..... 399/53, 265, 266, 399/290, 291, 272, 274, 281, 282, 284, 285; 430/120, 121

[56] References Cited

U.S. PATENT DOCUMENTS

| | | | |
|---|---|---|---|
| 3,697,169 | 10/1972 | Maksymiak et al. | 399/284 X |
| 3,707,390 | 12/1972 | Sullivan, Jr. | 430/121 |
| 3,914,460 | 10/1975 | Maksymiak | 430/120 |
| 3,998,185 | 12/1976 | Weiler | 399/265 |
| 3,999,849 | 12/1976 | Maksymiak et al. | 399/143 |
| 4,119,060 | 10/1978 | Mochizuki et al. | 399/284 |
| 4,445,771 | 5/1984 | Sakamoto et al. | 399/282 |
| 5,464,720 | 11/1995 | Baba et al. | 399/274 X |
| 5,666,619 | 9/1997 | Hart et al. | 399/266 |
| 5,826,147 | 10/1998 | Liu et al. | 399/237 |
| 5,899,608 | 5/1999 | Eklund et al. | 399/266 |
| 5,950,057 | 9/1999 | Erhardt et al. | 399/266 |

FOREIGN PATENT DOCUMENTS 58-021277 2/1983 Japan .

*Primary Examiner*—Sophia S. Chen
*Attorney, Agent, or Firm*—Lloyd F. Bean

[57] ABSTRACT

An apparatus for developing a latent image recorded on an imaging surface, including: a housing defining a reservoir storing a supply of developer material wherein the developer material having predefined triboelectric charge about 20 to 30 microCoulombs/gram. A donor member is mounted partially in the housing and spaced from the imaging surface, for transporting toner on an outer surface of the donor member to a region opposed from the imaging surface. An electrode member is disposed in between the donor member and the imaging surface. A system is provided for loading a region of the doner member with developer material. A charging device ion charges the toner loaded on the region of the donor member to a predefined charge level. A power supply electrically biases the electrode member positioned in close proximity to the imaging member to detach toner from the region of the donor member as to form a toner cloud for developing the latent image.

8 Claims, 2 Drawing Sheets

ION CHARGING DEVELOPEMENT SYSTEM

BACKGROUND OF THE INVENTION

This invention relates generally to a development apparatus for ionographic or electrophotographic imaging and printing apparatuses and machines, and more particularly is directed to a two component development system wherein a donor roll is loaded with triboelectrical charge toner particles, and subsequently the toner is charged by a corona device.

Co-pending patent application Ser. No. 09/036,731 entitled: "Ion Charging Development System To Deliver Toner With Low Adhesion" filed in the U.S. on Mar. 9, 1998; is hereby incorporated by reference.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. Toner particles are attracted to the latent image forming a toner powder image on the photoconductive surface. The toner powder image is subsequently transferred to a copy sheet, and finally, the toner powder image is heated to permanently fuse it to the copy sheet in image configuration.

The operating latitude of a powder xerographic development system is determined to a great degree by the case with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or mono-component (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

Jumping development systems, in which toner is required to jump a gap to develop the electrostatic latent image, are capable of image quality which can be superior to in-contact systems, such as magnetic brush development. Unfortunately, they are also much more sensitive to toner adhesion. In fact, high toner adhesion has been identified as a major limitation in jumping development. Up to now, mechanical and/or electrical agitation of toner have been used to break these adhesion forces and allow toner to be released into a cloud for jumping development. This approach has had limited success, however. More agitation often releases more toner, but high adhesion due to triboelectric charging still dominates in toner cloud generation and causes unstable development. For full color printing system architectures in which the complete image is formed on the image bearing member, an increase in toner delivery rate produces a highly interactive toner cloud, which disturbs previously developed particles on the latent image. This erases many of the original benefits of jumping development for color xerographic printing for the so-called image-on-image (IOI) architecture. Again, as the toner size is reduced, the above limitations become even more acute due to increased toner adhesion.

Given that charged particle adhesion is a major limiting factor in development with dry powder, it has been a goal to identify toner charging and delivery schemes which keep toner adhesion low. Clearly, the adhesion of the charged toner depends sensitively on the method used to charge the particles.

Another problem, it is extremely difficult to attain stable charge levels of 40 $\mu$c/g that magnitude with conductive development materials, which is itself required for uniform loading and reloading of the donor roll. Stable charge levels of that magnitude can be attained with insulative carrier (such as the Environcron blends from Scott Silence et al.), but these lead to severe reload defects. The developer cannot load sufficient toner onto the donor roll to compensate for the toner developed on the previous revolution. Conductive carrier designs have been identified by that have sufficiently high initial charge levels, but these have all been very unstable with time.

For optimum development of edges in cloud based systems an absolute charge level of 40 $\mu$c/g or higher is desirable. However, it is extremely difficult to attain stable charge levels of that magnitude with conductive development materials, which is itself required for uniform loading and reloading of the donor roll.

An object of the present invention is to run the two component conductive development materials in a development system wherein donor loading part of the system is accomplished at the most suitable charge level for stable dirt free performance with conductive two component development at 20 to 30 $\mu$c/g and raise the charge of the toner on the donor roll to the optimum for cloud development by means of ion charging to 40 $\mu$c/g or higher, thereby bridging the gap between what conductive two component development can deliver to the donor roll in the loading zone and what high resolution development requires from the donor roll in the development zone.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 1:
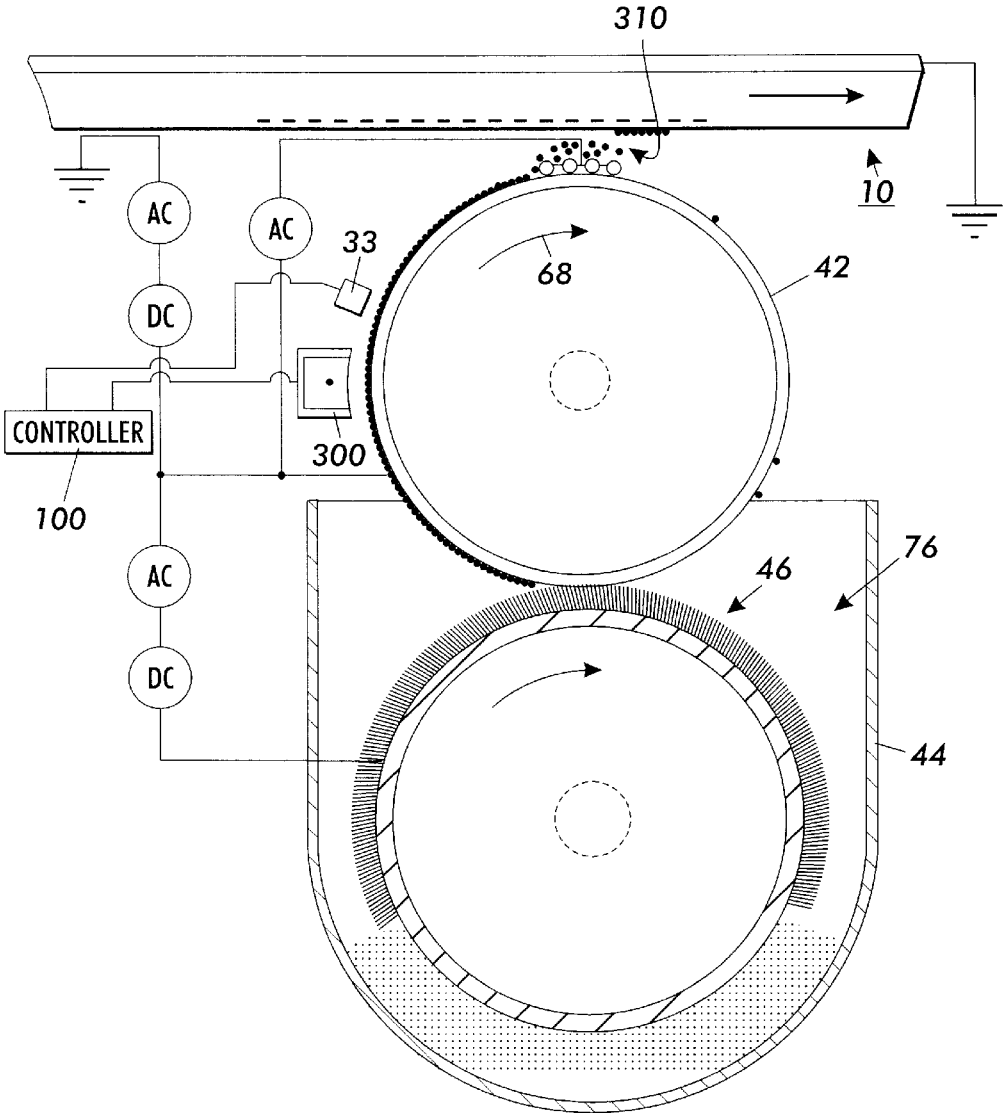
FIG. 1 is a schematic illustration of the development system according to the present invention.
Figure 2:
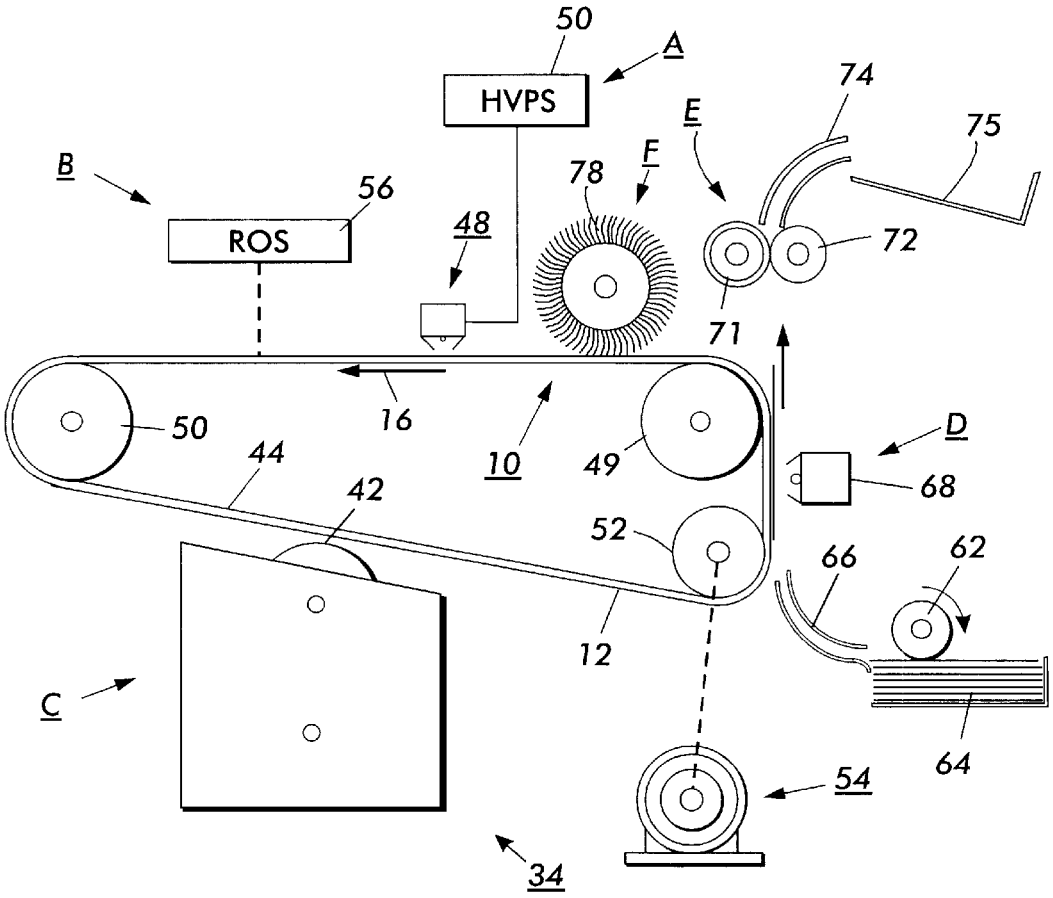
FIG. 2 is a schematic elevational view of an illustrative electrophotographic printing machine incorporating the present invention therein.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 44. Preferably the surface 12 is made from a selenium alloy. The substrate is preferably made from an aluminum alloy or a suitable photosensitive organic compound. The substrate is preferably made from a polyester film such as Mylar (a trademark of Dupont (UK) Ltd.) which has been coated with a thin layer of aluminum alloy which is electrically grounded. The belt is driven by means of motor 54 along a path defined by rollers 49, 50 and 52, the direction of movement being counter-clockwise as viewed and as shown by arrow 16. Initially a portion of the belt 10 passes through a charge station A at which a corona generator 48 charges surface 12 to a relatively high, substantially uniform, potential. A high voltage power supply 50 is coupled to device 48.

Next, the charged portion of photoconductive surface 12 is advanced through exposure station B. At exposure station B, ROS 56 lays out the image in a series of horizontal scan lines with each line having a specified number of pixels per inch. The ROS includes a laser having a rotating polygon mirror block associated therewith. The ROS imagewise exposes the charged photoconductive surface 12.

After the electrostatic latent image has been recorded on photoconductive surface 12, belt 10 advances the latent image to development station C as shown in FIG. 2. At development station C, a development system or developer unit 34, develops the latent image recorded on the photoconductive surface. The chamber in the developer housing stores a supply of developer material. The developer material preferably is two component developer consisting of carrier and toner particles. The developer material may be a custom color consisting of two or more different colored dry powder toners.

Again referring to FIG. 2, after the electrostatic latent image has been developed, belt 10 advances the developed image to transfer station D, at which a copy sheet 64 is advanced by roll 62 and guides 66 into contact with the developed image on belt 10. A corona generator 68 is used to spray ions on to the back of the sheet so as to attract the toner image from belt 10 to the sheet. As the belt turns around roller 49, the sheet is stripped therefrom with the toner image thereon.

After transfer, the sheet is advanced by a conveyor (not shown) to fusing station E. Fusing station E includes a heated fuser roller 71 and a back-up roller 72. The sheet passes between fuser roller 71 and back-up roller 72 with the toner powder image contacting fuser roller 71. In this way, the toner powder image is permanently affixed to the sheet. After fusing, the sheet advances through chute 74 to catch tray 75 for subsequent removal from the printing machine by the operator.

After the sheet is separated from photoconductive surface 12 of belt 10, the residual developer material adhering to photoconductive surface 12 is removed therefrom by a rotating fibrous brush 78 at cleaning station F in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

As the donor 42 rotates in the direction of arrow 68, A DC or DC plus AC voltage is applied to the donor roll to electrostatically transfer the desired polarity of toner to the roll. Donor roll 42 is mounted, at least partially, in the chamber of developer housing 44. The chamber in developer housing 44 stores a supply of developer material. Developer material employed is two component conductive development materials. Donor 42 develops toner via conventional magnetic brush 46 onto the surface of donor 42. This donor roll generally consists of a conductive aluminum core covered with a thin ( 50 $\mu$m) insulating anodized layer. The mag brush roll is held at an electrical potential difference relative to the donor core to produce the field necessary for toner development on to donor 42. In the developer housing 44 the developer acquires a triboelectric charge preferably about 20 to 30 microCoulombs/gram. A charge the layer of charged toner having a low tribo charge about 20 to 30 microCoulombs/gram is loaded on to donor 42 by magnetic brush 46. Next the layer of charged toner is brought under corona charging device 300, where the toner is charged to an average Q/M ratio of from −30 to −50 microCoulombs/gram. Corona device 300 may be in the form of an AC or DC charging device (e.g. scorotron). As donor 42 is rotated further in the direction indicated by arrow 68, the now charged toner layer is moved into development zone 310, defined by the gap between donor 42 and the surface of the photoreceptor belt 10. The toner layer on the donor roll is then disturbed by electric fields from a wire or set of wires so as to produce an agitated cloud of toner particles. The cloud is also sustained by the AC voltage applied to the wires in the form of a square wave. Typical signal magnitudes are 700–900 Vpp at frequencies of 3–10 kHz. Toner from the cloud is then developed onto the nearby photoreceptor by fields created by a latent image As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser. In this manner, a substantially constant amount of toner particles are in the fluidizing reservoir of the developer housing.

It has been found that the use of a corona device to boost the toner charge allows compensation for humidity variation, since a given developer may range in charge from 35 $\mu$c/g at low humidity to 20 $\mu$c/g at high humidity. In combination with the appropriate sensors, which could be an electrostatic voltmeter 33 to measure the surface potential of the toner layer on the donor roll. Ion charging device can be adjusted by a controller 100 to an output corona charge that allows toner loaded over the range of charge to be brought to the optimum value before development of the latent image.

It has been found that, using corona devices to charge toner produces particles with lowered adhesion compared which has been solely tribo-electrically charged. This is due to the fact that ion charging distributes charges more uniformly on the toner surface. Since a significant fraction of the toner charge is deposited by ion charging in this invention, the particles experience an adhesion reduction and be more easily detached into the toner cloud than particles which are charged to the high levels needed to reduce halo purely by triboelectric charging.

In summary, there is provided a development system of the present invention that utilizes ion charging of toner. The resulting toner delivery system is designed to produce charged, low adhesion toner and present it gently to an electrostatic latent image in the form of a toner cloud.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a housing defining a reservoir storing a supply of developer material wherein said developer material having predefined triboelectric charge;

a donor member, mounted partially in said housing and spaced from the imaging surface, for transporting toner on an outer surface of said donor member to a region opposed from the imaging surface, an electrode member disposed in between said donor member and said imaging surface;

means for loading a region of said doner member with developer material;

means for ion charging said toner loaded on the region of said donor member to a predefined charge level;

means for measuring the charge level on the region on said donor member;

a controller responsive to said measuring means, for adjusting charging output of said ion charging means means for electrically biasing said electrode member positioned in close proximity to said imaging surface to detach toner from said region of said donor member as to form a toner cloud for developing the latent image.

2. The apparatus as recited in claim 1, wherein said predefined triboelectric charge is about 20 to 30 microCoulombs/gram.

3. The apparatus as recited in claim 1, wherein said predefined charge level is about 30 to 50 microCoulombs/gram.

4. The apparatus as recited in claim 1, wherein ion charging means comprises a DC or AC corona device located adjacent to the surface of said donor member.

5. The apparatus as recited in claim 1, wherein said developer material comprises two component developer materials.

6. A method for developing a latent image recorded on an imaging surface, comprising the steps of:

storing a supply of developer material in a reservoir wherein said developer material having predefined triboelectric charge;

loading a region of a donor member with developer material transporting developer material said region donor member from said reservoir to a region opposed from the imaging surface, ion charging said developer material loaded on the region of said donor member to a predefined charge level with a charging device electrically biasing an electrode member positioned in close proximity to said imaging surface to detach developer material from said region of said donor member as to form a toner cloud for developing the latent image; and measuring the charge level on the region on said donor member before said ion charging step; and adjusting charging output of said charging device.

7. The method of claim 6, wherein said predefined triboelectric charge is about 20 to 30 microCoulombs/gram.

8. The method of claim 6, wherein said predefined charge level is about 30 to 50 microCoulombs/gram.

* * * * *